US009004629B2

(12) United States Patent
de Jong et al.

(10) Patent No.: US 9,004,629 B2
(45) Date of Patent: Apr. 14, 2015

(54) IMAGE QUALITY BY PRINTING FREQUENCY ADJUSTMENT USING BELT SURFACE VELOCITY MEASUREMENT

(71) Applicant: Xerox Corporation, Norwalk, CT (US)

(72) Inventors: Joannes N. M. de Jong, Hopewell Junction, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 65 days.

(21) Appl. No.: 13/717,088

(22) Filed: Dec. 17, 2012

(65) Prior Publication Data

US 2014/0168298 A1 Jun. 19, 2014

(51) Int. Cl.

| | |
|---|---|
| ***B41J 29/38*** | (2006.01) |
| ***B41J 29/393*** | (2006.01) |
| ***B41J 11/00*** | (2006.01) |
| ***B41J 2/045*** | (2006.01) |

(52) U.S. Cl.

CPC ..... *B41J 11/007* (2013.01); *B41J 2/04503* (2013.01); *B41J 2/04581* (2013.01)

(58) Field of Classification Search

CPC ..... B41J 11/007; B41J 11/42; B41J 29/38; B41J 2/04581; B41J 29/393; B41J 2/04501; B41J 2/04503; G03G 15/0131; G03G 2215/0158; G03G 2215/00139; G03G 2215/1623; G03G 2215/0016

USPC ..... 347/9, 14, 16, 19, 104, 101; 399/66, 399/162, 301, 302

See application file for complete search history.

(56) References Cited

U.S. PATENT DOCUMENTS

| | | | | |
|---|---|---|---|---|
| 5,075,702 | A | 12/1991 | Castelli et al. | |
| 5,950,051 | A | 9/1999 | Casella | |
| 6,304,825 | B1 | 10/2001 | Nowak et al. | |
| 7,499,667 | B2 * | 3/2009 | Matsuda | 399/302 |
| 7,569,808 | B2 | 8/2009 | Yoshioka et al. | |
| 7,665,817 | B2 | 2/2010 | Folkins | |
| 2009/0304417 | A1 * | 12/2009 | Inoue | 399/301 |
| 2010/0295913 | A1 | 11/2010 | Domoto et al. | |
| 2011/0048324 | A1 | 3/2011 | Yamashita et al. | |

* cited by examiner

*Primary Examiner* — Jannelle M Lebron

(74) *Attorney, Agent, or Firm* — Hoffmann & Baron, LLP

(57) ABSTRACT

Embodiments described herein are directed to a reflex printing system with improved image quality. A media transport moves a media substrate or an intermediate belt along a media path in a process direction past the two or more print heads, which deposit inks onto the media substrate or the intermediate belt. A velocity measuring device directly measures and transmits the speed of the surface of belt or media that is to receive the image to a controller, which sends print commands to the two or more print heads to control the frequency of the printing. The inks deposited on the media substrate or intermediate belt have a color registration of from 10 to 20 microns.

11 Claims, 6 Drawing Sheets

IMAGE QUALITY BY PRINTING FREQUENCY ADJUSTMENT USING BELT SURFACE VELOCITY MEASUREMENT

BACKGROUND

1. Technical Field

The presently disclosed technologies are directed to a system and method for improving image quality by adjusting the printing frequency. The system and method described herein measure the belt surface velocity and use it to adjust the printing frequency.

2. Brief Discussion of Related Art

In order to ensure good image quality (IQ) in cut sheet direct to paper (DTP) ink jet printing, a media transport system must transport the media through the print zone at a controlled rate. Methods of choice for the media transport use a belt module that tacks the media to the surface of the belt using vacuum or electrostatic forces. In order to assure accurate printing, the belt with the tacked media must be held firmly against a support. Deviations of belt surface velocity from a nominal value cause defects in the printed image. These deviations can be caused by, but are not limited to, velocity variations caused by belt thickness variations, variation in drag over the belt support area and roll tolerances in the belt module.

FIG. 1 shows an exemplary production printing system that could be used with the present invention. The media is tacked to a belt using electrostatic or vacuum forces and the media transport belt module transports the sheet through a printing zone. In addition, the belt is held firmly against a support (e.g., a flat platen as shown in FIG. 1 or a curved surface). Deviations in the belt transport velocity can cause color registration error, i.e., color separations so that colors are not printed at the intended locations. This results in image quality defects.

Reflex printing is a method known in the art, which is used to mitigate image quality defects. Conventional reflex printing is done on a belt module roll or, in the case of a drum architecture system, the printing is done on the main drum encoder. In reflex printing, the frequency of the image generation is a function of a measured velocity of the printing media passing under the print heads. In its simplest implementation, the image generation frequency (i.e., the firing of the print heads) is proportional to the measured roll/drum angular velocity. This allows two or more colors printed by print heads in different locations to coincide and provides a great improvement in image quality.

In a belt module, the angular velocity of a roll is not an extremely accurate measure of the belt surface or media transport velocity. Inaccuracies in the rolls of the module, belt thickness variation, variable drag/friction, etc. contribute to media transport velocity variations that are uncompensated when reflex printing using based on the angular velocity of the belt drive roll. Color-to-color registration errors are positional errors, i.e. they result from the integral of velocity errors over time. For long wave lengths, small velocity errors can integrate to substantial position errors. In contrast, short wave length (very high frequency) errors integrate to a relatively smaller positional error. The belt length represents a long wave length and belt thickness variations are known to cause substantial color-to-color registrations errors. Accordingly, there is a need for a reflex printing system that that can accurately register two or more colors and improve the image quality.

SUMMARY OF THE INVENTION

The present invention is a reflex printing system with improved image quality. The system includes: two or more print heads; a media transport; a device for measuring the velocity of the media substrate or belt surface; and a controller. The two or more print heads deposit two or more inks onto a media substrate or an intermediate belt. Typically, more than two colors are used and the combinations of two or more colors enable different colors of different hues to be printed. The media transport moves the media substrate or the intermediate belt along a media path in a process direction past the two or more print heads. The media transport can include a media transport belt for transporting a media substrate. The media transport belt or intermediate belt having an internal surface, an external surface and a belt speed. The media substrate can be tacked to the surface of the belt using vacuum or electrostatic forces. The intermediate belt can similarly be tacked in place under the print heads.

The velocity measuring device is preferably an encoder and most preferably an optical encoder. The encoder measures the speed and is operatively connected to a wheel in contact with the media substrate or the external surface of the media transport belt or the intermediate belt. The wheel rotatably contacts the media transport belt, the intermediate belt or the media substrate and transmits an electrical signal corresponding to the measured speed. The controller receives the electrical signal for the measured speed and transmits print commands to the two or more print heads. Preferably, the controller controls the frequency of the printing of the two or more print heads. In one embodiment, the controller calculates the variation of the measured speed from a predetermined speed to provide a speed deviation and transmits print commands to the two or more print heads based on the speed deviation.

At least two of the two or more inks deposited on the media substrate or the intermediate belt by the two or more print heads are in color registration with respect to each other. Preferably, the inks deposited on the media substrate or the intermediate belt have a color registration of from 10 to 100 microns, more preferably from 10 to 50 microns and most preferably from 10 to 20 microns or less than 15 microns. In one embodiment, the inks are deposited on the media substrate or the intermediate belt by four print head systems that have a color to color registration of from 10 to 50 microns, preferably from 10 to 20 microns.

DETAILED DESCRIPTION

Figure 1:
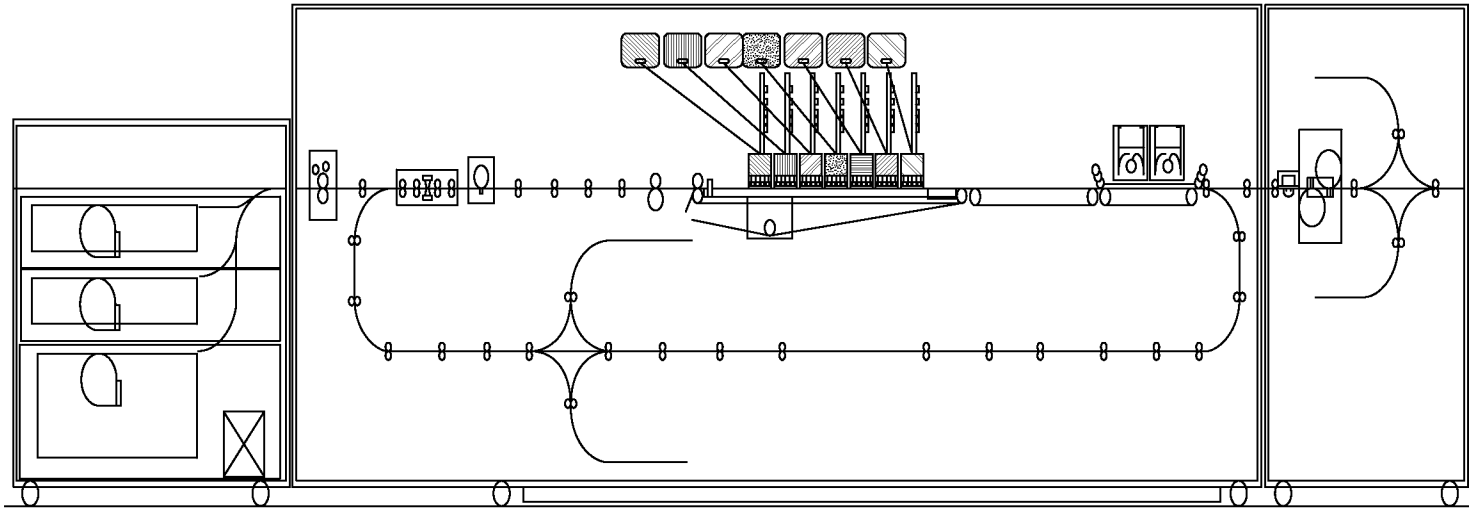
FIG. 1 PRIOR ART
FIG. 1 depicts a prior art ink jet printing system that uses a belt based registration transport to transport media past the print heads.

The present invention is a direct marking belt media transport system with an imaging system that adjusts printing frequency using a media substrate or belt surface velocity measurement. In particular, the printing frequency can be proportional to the velocity of the media substrate or the belt surface velocity. This reduces color-to color registration errors with a significant improvement in image quality compared to printing systems currently being used. A preferred device for measuring media substrate or belt surface velocity is a rotary optical encoder with a shaft connected to a wheel that contacts the external surface of the media substrate or the belt. This system is more accurate than measuring the rotation of the belt drive rollers because it avoids errors due to roll run-out, belt thickness variation and micro-slip at the belt-to-roll interface.

As used herein, "substrate media" and "media" refer to a tangible medium, such as paper (e.g., a sheet of paper, a long web of paper, etc.), transparencies, parchment, film, fabric, plastic, photo-finishing papers or other coated or non-coated substrates on which information or on an image can be printed, disposed or reproduced. While specific reference herein is made to a sheet or paper, it should be understood that any substrate media in the form of a sheet amounts to a reasonable equivalent thereto. This invention also applies to a system that prints onto an intermediate belt for subsequent transfer of the ink from the intermediate belt onto the media.

As used herein, the term "color-to-color registration" refers to two or more inks of different colors that are printed on a designated location on a substrate. In reflex printing, the objective is to print one or more colors on the media in accurate alignment relative to each other, often to produce a third color. Two colors are "registered" or "in registration" when one color is printed precisely relative to the other color. In such a case, the color-to-color registration is 0 micron. However, when one color is not printed exactly relative to another color, the distance that the two colors are out of registration determines the accuracy of the printing process and is measured in microns. For example, when a reflex printing process has a color-to-color registration of less than 15 microns, it means that one color is misaligned relative to the other color by a maximum of 15 microns.

As used herein, the term "reflex printing" refers to a method of printing which adjusts the firing of print heads based on the measured speed of the imaging surface, media or substrate. In its simplest form, the firing of the print heads is proportional to the measured speed of the imaging surface. This causes consecutive drops from a single print head to be placed equidistantly on the imaging surface and drops from multiple print heads to exhibit no spatial variation relative to each other, thus maintaining constant registration.

As used herein, the terms "process" and "process direction" refer to a process of moving, transporting and/or handling a substrate media. The process direction substantially coincides with a direction of a flow path P along which the substrate media is primarily moved within the media handling assembly. Such a flow path P is the flow from upstream to downstream.

As used herein, an "image" refers to visual representation, such as a picture, photograph, computer document including text, graphics, pictures, and/or photographs, and the like, that can be printed on media.

As used herein, an "intermediate belt" refers to a printing system wherein the print heads do not print directly onto the media substrate. Instead, the print heads deposit ink onto a belt and the belt subsequently contacts the media substrate to transfer the ink onto the media substrate. Printing systems using an intermediate belt are disclosed in U.S. Patent Application Publication No. US 2010/0295913 to Domoto et al. and U.S. Patent Application Publication No. US 2011/0048324 to Yamashita et al., both of which are incorporated herein in their entirety.

As used herein, a "phase change ink-jet printer" refers to a type of ink-jet printer in which the ink begins as a solid and is heated to convert it to a liquid state. While it is in a liquid state, the ink drops are propelled onto the substrate from the impulses of a piezoelectric crystal. Once the ink droplets reach the substrate, another phase change occurs as the ink is cooled and returns to a solid form instantly. The print quality is excellent and the printers achieve good image quality on inexpensive papers since the solid ink does not bleed like many other inks, however it should be appreciated that this invention can be used with an ink jet printing system using aqueous inks, UV curable inks or any other type of ink.

As used herein, a "location" refers to a spatial position with respect to reference point or area.

As used herein, a "media printing system" or "printing system" refers to a device, machine, apparatus, and the like, for forming images on substrate media using ink, toner, and the like, and a "multi-color printing system" refers to a printing system that uses more than one color (e.g., red, blue, green, black, cyan, magenta, yellow, clear, etc.) ink or toner to form an image on substrate media. A "printing system" can encompass any apparatus, such as a printer, digital copier, bookmaking machine, facsimile machine, multi-function machine, etc. which performs a print outputting function. Some examples of printing systems include Xerographic, Direct-to-Paper (e.g., Direct Marking), modular overprint press (MOP), ink jet, solid ink, as well as other printing systems.

In one embodiment, the present printing system uses an external encoder with a roller that directly measures the velocity of cut-sheet media directly, the external surface of a transport belt or the external surface of the intermediate belt. This method is more accurate than methods that measure the revolutions of an internal roller. The velocity of a cut-sheet transported on a belt may not be the same as the internal velocity of the belt as measured by an encoder on an internal roller due to slip/creep at the belt to roller interface. The roller can move at a measured velocity but the belt may not always move at the same velocity. A belt surface encoder eliminates errors due to roller run-out for rollers that are non-synchronous with the imaging pitch, belt thickness variation and servo drive errors, e.g., drag force variations. These errors can easily add up to 30-50 microns of inaccuracy to the color-to-color registration in a reflex printing system. An external roller that directly contacts the cut-sheets or the external surface of the transport belt or intermediate belt is a direct measurement of the velocity of the media and the belt and is more accurate. Also, the footprint may be smaller since it is not necessary to make the machine synchronous to achieve good color to color registration. With a conventional system that uses an encoder on the drive roll, registration errors can be minimized by designing the system such that the spacing between color printing stations is an even integer of the circumferential length of the drive roll diameter and this can increase the size of the system.

Although the printing method is described herein with a rotary optical surface encoder used to measure the velocity of the belt or media, other velocity measurements of the media substrate or the surface of a belt can also be used. Examples include systems that detect marks on the belt, non-contact laser velocimeters and other similar devices that are well known to one skilled in the art. Accordingly, the invention is not limited to optical encoders and encompasses systems that directly measure the velocity of the media substrate or the belt using other devices.

The reflex printing system improves image quality by improving the registration accuracy of two or more colors of ink on the media surface. By more accurately measuring the velocity of the media, the controller can more precisely regulate the print frequency of the print heads and improve the color-to-color registration. Various velocity measuring devices can be used with optical encoders being preferred. The reflex printing system of the present invention provides color to color registration with an accuracy of between 10 or 100 microns, more preferably between 10-50 microns and most preferably between 10-20 microns. In a most preferred embodiment, the color-to-color registration is less than 15 microns.

The exemplary embodiments of the present invention are now discussed in further detail with reference to the figures.

Figure 2:
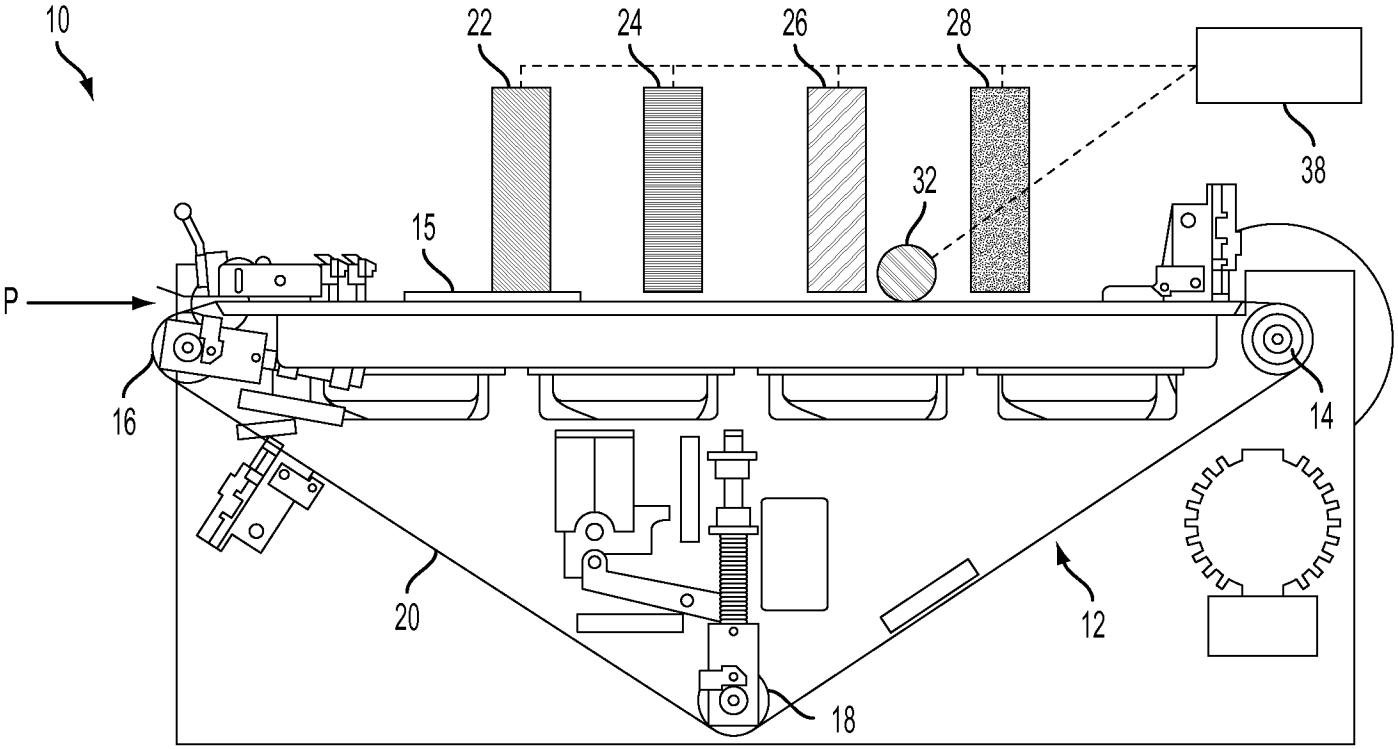
FIG. 2 depicts a printing system that uses color-to-color registration method of the present invention to print on a media substrate.

Referring now to the drawings, FIG. 2 shows a reflex printing system 10 with an exemplary belt module 12. The belt module 12 has three rolls, i.e., a drive roll 14, a steering roll 16 and a tensioning roll 18, which move the transport belt 20 to convey the media substrate 15 under four print heads 22, 24, 26, 28. The drive roll 14 has a servo operator for controlling its speed. To measure the belt surface velocity, a wheel 32 mounted on the shaft 34 of the rotary optical encoder 30 is loaded against the media substrate 15 or the belt surface 36 near the edge of the belt 20. (See FIGS. 4 and 5.) The output signal of the encoder 30 is typically a pulse train, which is processed to obtain a belt surface velocity measurement. The encoder 30 measures and transmits the media or belt surface velocity to a controller 138. The printing frequency of each of the print heads 22, 24, 26, 28 is adjusted based on this belt surface velocity measurement. In FIG. 2, the surface encoder wheel 32 is shown positioned between two of the print heads 26, 28. One skilled in the art would appreciate that the wheel 32 can be positioned at other locations along the belt 20 between the drive roller 14 and steering roller 16.

Figure 3:
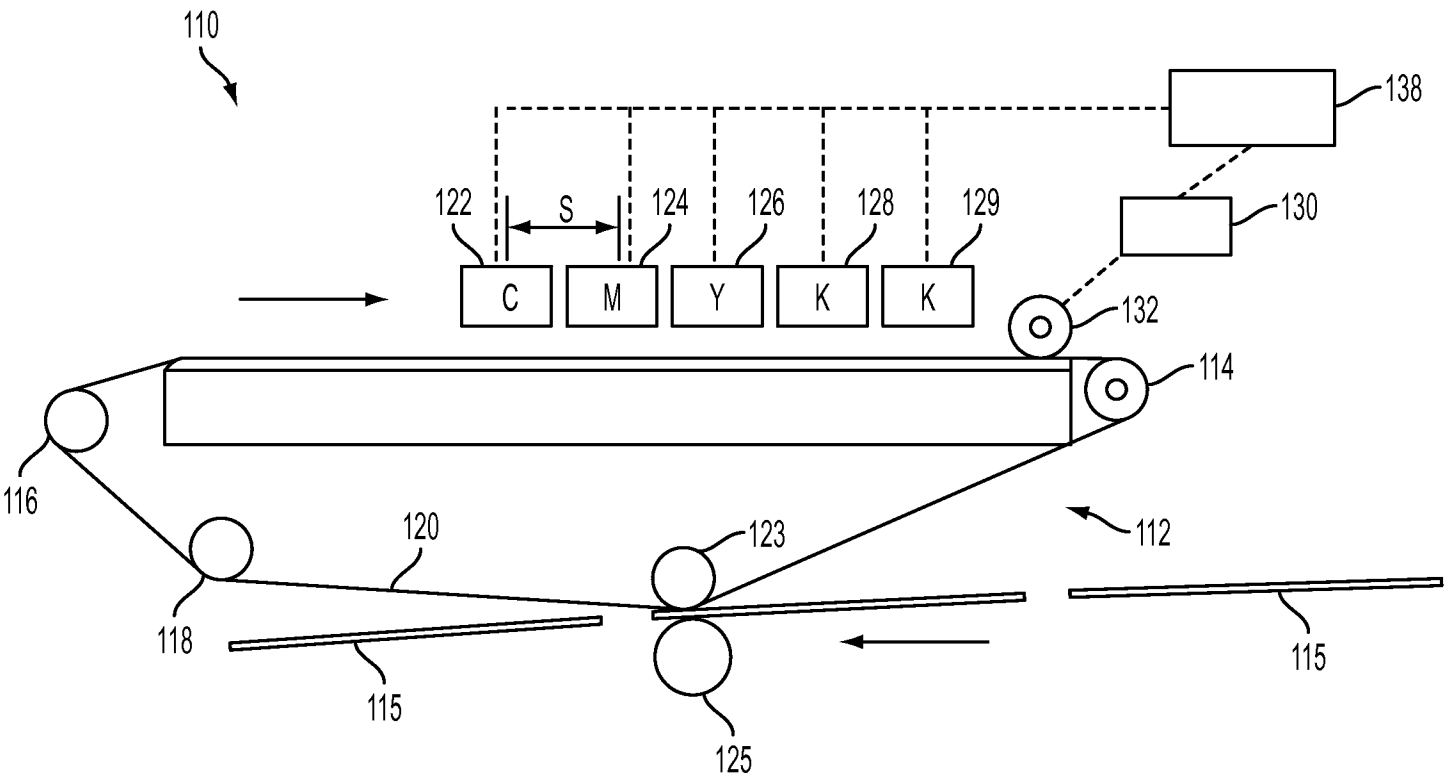
FIG. 3 depicts a printing system that uses color-to-color registration method of the present invention to print on an intermediate belt.

FIG. 3 shows an embodiment of the reflex printing system 110 with an intermediate belt belt module 112. The intermediate belt module 112 has five rolls, i.e., a drive roll 114, a steering roll 116, a tensioning roll 118 and a pair of nip rolls 123, 125. This system transports the intermediate belt 120 under five print heads 122, 124, 126, 128, 129. The drive roll 114 has a servo operator for controlling its speed. To measure the belt surface velocity, a wheel 132 connected to the rotary optical encoder 130 is loaded against the intermediate belt 120 near the edge of the belt. The encoder 130 measures and transmits the intermediate belt 120 surface velocity to a controller 138. The printing frequency of each of the print heads 122, 124, 126, 128, 129 is adjusted based on this belt surface velocity measurement. The surface encoder wheel 132 is shown positioned between the drive roll 14 and one of the print heads 129. However, one skilled in the art would appreciate that the wheel 132 can be positioned at other locations along the belt 120 between the drive roller 114 and steering roller 116.

Figure 5:
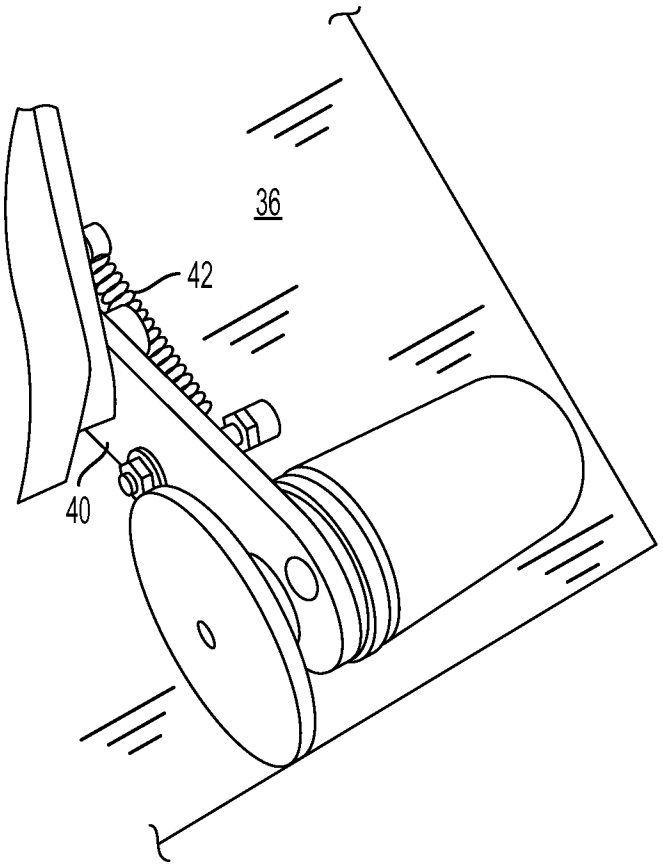
FIG. 5 depicts a perspective view of the encoder in FIG. 3.
Figure 4:
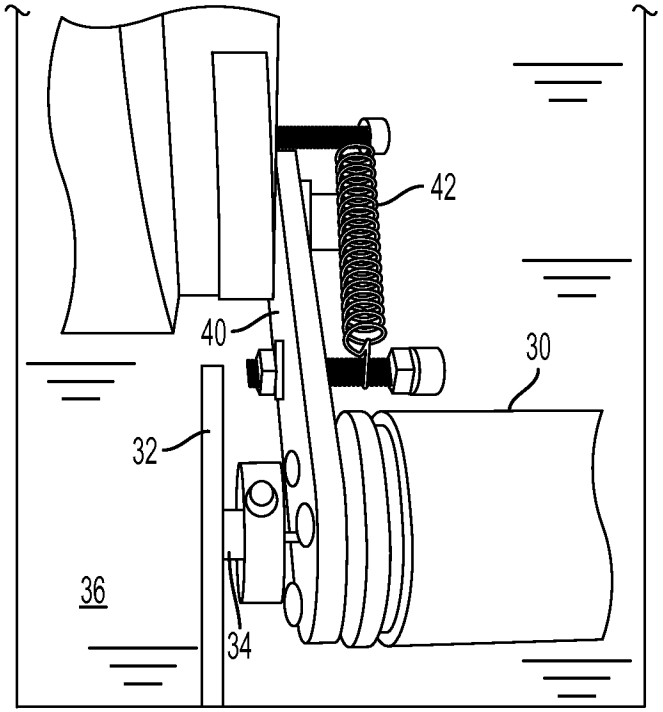
FIG. 4 depicts a side view of an encoder with a wheel that is spring-loaded against the media.

The rotary optical surface encoder 30 is shown in FIGS. 4 and 5. Typically, the encoder 30 is mounted on an arm 40 and held in contact with the belt surface 36 by a tensioning assembly 42. Such tensioning assemblies 42 are well known to those skilled in the art.

EXAMPLES

Example 1

Data were collected using a belt surface roll-mounted encoder, which has a tracking wheel mounted to the end of a rotatable shaft. The tracking wheel is loaded directly against the belt and measures the velocity of the belt when it moves.

Although the printing frequency is proportional to belt surface velocity, the validation data is represented in terms of positional information, which represents color-to-color registration errors. It also more clearly demonstrates the contribution of longer wave length, smaller errors. The positions were calculated as the integral over time of the measured velocity minus its average velocity over a certain time interval (about 58 seconds). The results are shown in FIG. 6.

The surface encoder position A shows the contributions from all error sources, including roll/wheel errors, belt thickness variations and belt drive servo errors. Roll/wheel errors are typically due to eccentricity of roll/wheels, mounting error, etc. These types of errors include encoder errors and are more clearly illustrated in FIG. 6. Specific examples of these errors include drive train errors (i.e. motor pulley, load pulley, motor pole frequency, timing belt error, gear train errors), other belt module roll errors and surface encoder error.

Figure 6:
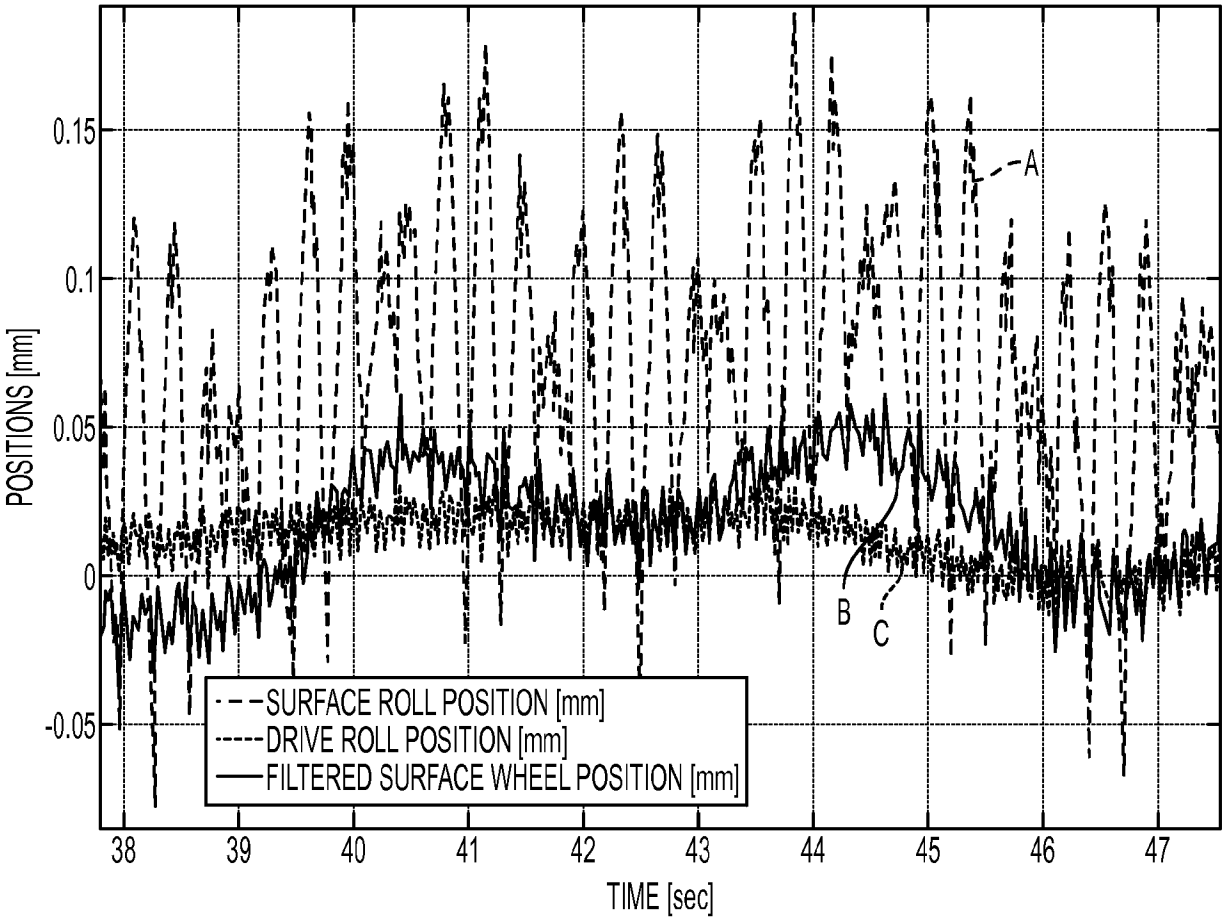
FIG. 6 is a graph that plots time versus position for the surface roll position, the drive roll position and the filtered surface wheel position.

The error from belt thickness variation B is shown more clearly in FIG. 6. It is extracted by filtering out the high frequencies in the surface encoder measurement. The periodicity corresponds to one revolution of the belt. Also shown in FIG. 6 is the belt drive servo error C, which was measured directly from the encoder mounted on the drive roll and has the least deviation of the three curves A, B, C. Belt drive servo error C is part of the variation that is measured by the surface encoder.

The error from the belt surface encoder is a false error, i.e. it does not represent actual belt velocity error. An encoder, like any other measurement device, has an inherent error. This error is superimposed on the measured imaging surface velocity but it does not represent actual belt velocity error. This error can be filtered out with a notch filter or can be calibrated. One method for filtering out the error is disclosed in U.S. Pat. No. 6,304,825 to Nowak et al., which is incorporated herein in its entirety.

Example 2

Estimates to determine the approximate color-to-color registration errors using different design, measurement and compensation approaches (based on estimated magnitudes of error sources) were generated based on historical test results. Some of the estimates assumed synchronous design rules, wherein the circumference of the drive roll is an integer multiple of the spacing (S) (see FIG. 3.) between adjacent print heads. This can require a larger printing system and result in less efficient space utilization (i.e., size of the system). The following six different printing systems were estimated to determine the approximate registration error in microns.

1. Constant velocity transport using non-synchronous design rules.
2. Constant velocity transport using synchronous design rules.
3. Reflex printing based on drive roll encoder using non-synchronous design rules.
4. Reflex printing based on drive roll encoder using synchronous design rules.
5. Reflex printing based on surface roll encoder using non-synchronous design rules.
6. Reflex printing based on surface roll encoder using synchronous design rules.

Figure 7:
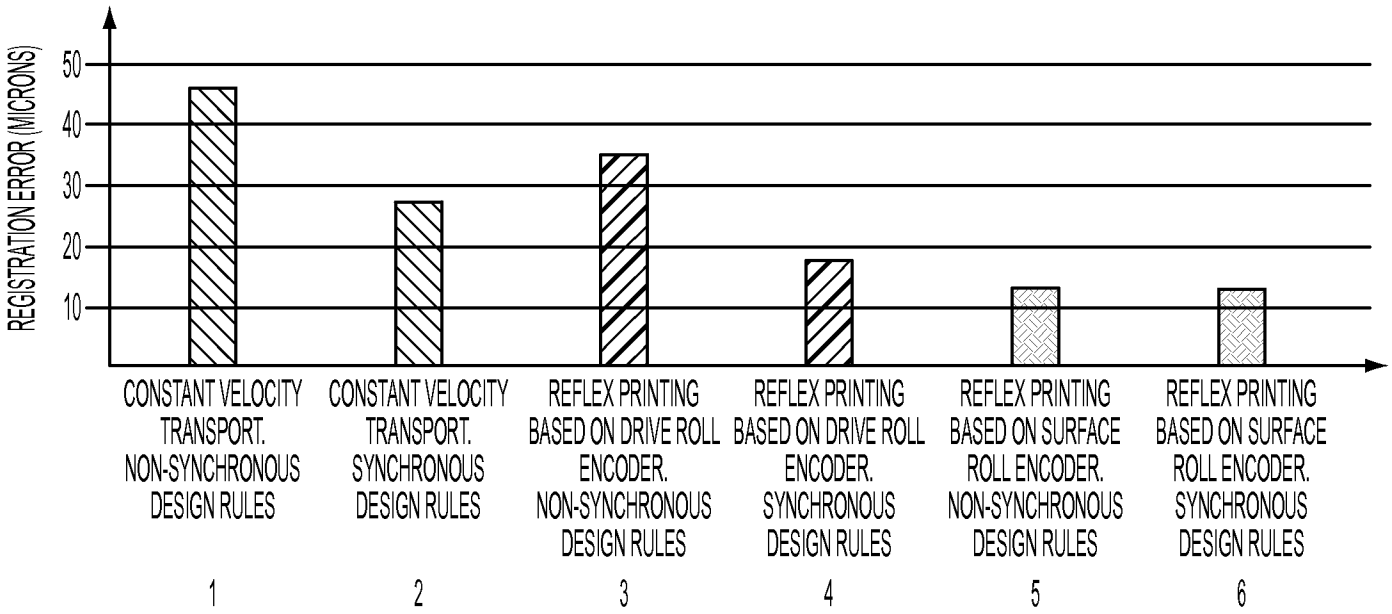
FIG. 7 is a graph showing predicted color-to-color registration results using different printing systems.

The results are shown in FIG. 7, which shows a bar graph for the registration error of each method. A comparison of the results shows that systems using a surface roll encoder (test methods 5 and 6) have the lowest registration errors.

It will be appreciated that various embodiments of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A reflex printing system with improved image quality, the system comprising:

two or more print heads for depositing two or more inks onto a media substrate or an intermediate belt;

a media transport for moving the media substrate along a media path in a process direction past the two or more print heads, wherein the media transport comprises a media transport belt having an internal surface, an external surface and a belt speed;

a device that contacts the external surface of the media transport belt or media being transported by said belt for measuring the speed thereof, wherein the device transmits an electrical signal corresponding to the measured speed of the media transport belt or media; and a controller for receiving the electrical signal for the measured speed and transmits print commands to the two or more print heads based on the measured speed, wherein at least two of the two or more inks deposited on the media substrate or intermediate belt by the two or more print heads are in color registration with respect to each other.

2. The reflex printing system with improved image quality according to claim 1, wherein the device is an optical encoder.

3. The reflex printing system with improved image quality according to claim 2, wherein the optical encoder includes a wheel that rotatably contacts the media transport belt or media substrate.

4. The reflex printing system with improved image quality according to claim 1, wherein the controller controls the frequency of the printing of the two or more print heads.

5. The reflex printing system with improved image quality according to claim 1, wherein the controller calculates the variation of the measured speed from a predetermined speed to provide a speed deviation and transmits print commands to the two or more print heads based on the speed deviation.

6. The reflex printing system with improved image quality according to claim 1, wherein the inks deposited on the media substrate or the intermediate belt have a color registration of from 10 to 100 microns.

7. The reflex printing system with improved image quality according to claim 1, wherein the inks deposited on the media substrate or the intermediate belt have a color registration of from 10 to 50 microns.

8. The reflex printing system with improved image quality according to claim 1, wherein the inks deposited on the media substrate or the intermediate belt have a color registration of from 10 to 20 microns.

9. The reflex printing system with improved image quality according to claim 1, wherein the inks deposited on the media substrate or the intermediate belt have a color registration of less than 15 microns.

10. The reflex printing system with improved image quality according to claim 1, wherein the inks are deposited by at least four print head systems on the media substrate or the intermediate belt and have a color registration of from 10 to 20 microns.

11. The reflex printing system with improved image quality according to claim 1, wherein the media substrate or the intermediate belt is tacked to the surface of the belt using vacuum or electrostatic forces.

* * * * *